US006109230A

United States Patent [19]

Watanabe et al.

[11] Patent Number: 6,109,230

[45] Date of Patent: Aug. 29, 2000

[54] DECOMPRESSION DEVICE FOR AN ENGINE

[75] Inventors: Mitsunori Watanabe, Shizuoka-ken; Kenji Imafuku, Tokyo; Takanobu Koguchi, Tokyo, all of Japan

[73] Assignees: Fuji Robin Kabushiki Kaisha, Shizuoka-ken; Shin-Daiwa Kogyo Co., Ltd., Hiroshima-ken; Fuji Jukogyo Kabushiki Kaisha, Tokyo, Japan

[21] Appl. No.: 09/152,226

[22] Filed: Sep. 11, 1998

[30] Foreign Application Priority Data

Sep. 16, 1997 [JP] Japan ..... 9-250806

[51] Int. Cl.[7] ..... F01L 13/08

[52] U.S. Cl. ..... 123/182.1

[58] Field of Search ..... 123/182.1

[56] References Cited

U.S. PATENT DOCUMENTS 4,977,868 12/1990 Holschuh ..... 123/182.1

5,943,992 8/1999 Kojima et al. ..... 123/182.1

FOREIGN PATENT DOCUMENTS 0555805 8/1993 European Pat. Off. ..... 123/182.1

*Primary Examiner*—Andrew M. Dolinar
*Attorney, Agent, or Firm*—Martin A. Farber

[57] ABSTRACT

A cam gear is mounted on a camshaft, and an intake cam and an exhaust cam are formed on the cam gear for operating an intake valve and an exhaust valve of a hand starting four-cycle engine. A decompression device is rotatably mounted in the cam gear. A decompression cam of the decompression device is exposed from the exhaust cam. The decompression device has a weight, and a spring is provided for urging the weight to the cam shaft. Elastic force of the spring is set so that the weight is urged toward the camshaft in hand starting operation of the engine and moved apart from the camshaft by centrifugal force, thereby projecting the decompression cam in the compression stroke of the engine as to open the corresponding valve.

4 Claims, 6 Drawing Sheets

DECOMPRESSION DEVICE FOR AN ENGINE

BACKGROUND OF THE INVENTION

The present invention relates to a decompression device for a hand starting four-cycle engine, and more particularly to the decompression device for a small utility engine used for a hand sprayer and a brush cutter.

Heretofore, the two-cycle engine is employed for the portable machine such as the hand sprayer, the brush cutter, and the like. However, the two-cycle engine has defects that exhaust noise is large, and the quantity of hydrocarbon in exhaust gases is large.

Therefore, the employing of the four-cycle engine is considered. The four-cycle engine has been improved in miniaturization and weight reduction. Such a small four-cycle engine is manually started with a recoil starter in general. Namely, the crankshaft of the engine is rotated by pulling a wire of the recoil starter.

The decompression device is provided in the small hand starting four-cycle engine so as to open slightly the exhaust valve in the compression stroke for decreasing the compression pressure in order to reduce the manual force at the cranking operation.

In order to temporarily open the exhaust valve, the decompression device has a complicated mechanism for temporarily operating the cam mechanism for operating the intake and exhaust valves. Therefore, the decompression device hinders miniaturizing the four-cycle engine.

On the other hand, cams for operating the valves are separately provided for the intake valve and the exhaust valve in order to exactly control the opening operation of the valves. There is a problem of how to mount the decompression device on the engine.

SUMMARY OF THE INVENTION

An object of the present invention is to provide a decompression device which is simple in construction and small in size.

Another object of the present invention is to provide a decompression device which may control the intake and exhaust valve with higher accuracy.

In accordance with the present invention, a cam gear is mounted on a camshaft of a hand starting four-cycle engine. A gear portion of the cam gear engages with a gear on a crankshaft of the engine. An intake cam and an exhaust cam are formed on the cam gear for operating an intake valve and an exhaust valve of the engine. A decompression device has a shaft portion rotatably mounted in the cam gear, a decompress cam exposed from the exhaust cam. A weight is provided in the cam gear, and a spring is provided for urging the weight to the camshaft. The biasing force of the spring is set so that the weight is urged toward the camshaft in hand-starting operation and moved apart from the camshaft by centrifugal force, thereby projecting the decompression cam.

DETAILED DESCRIPTION OF THE PREFERRED EMBODIMENT

Figure 1:
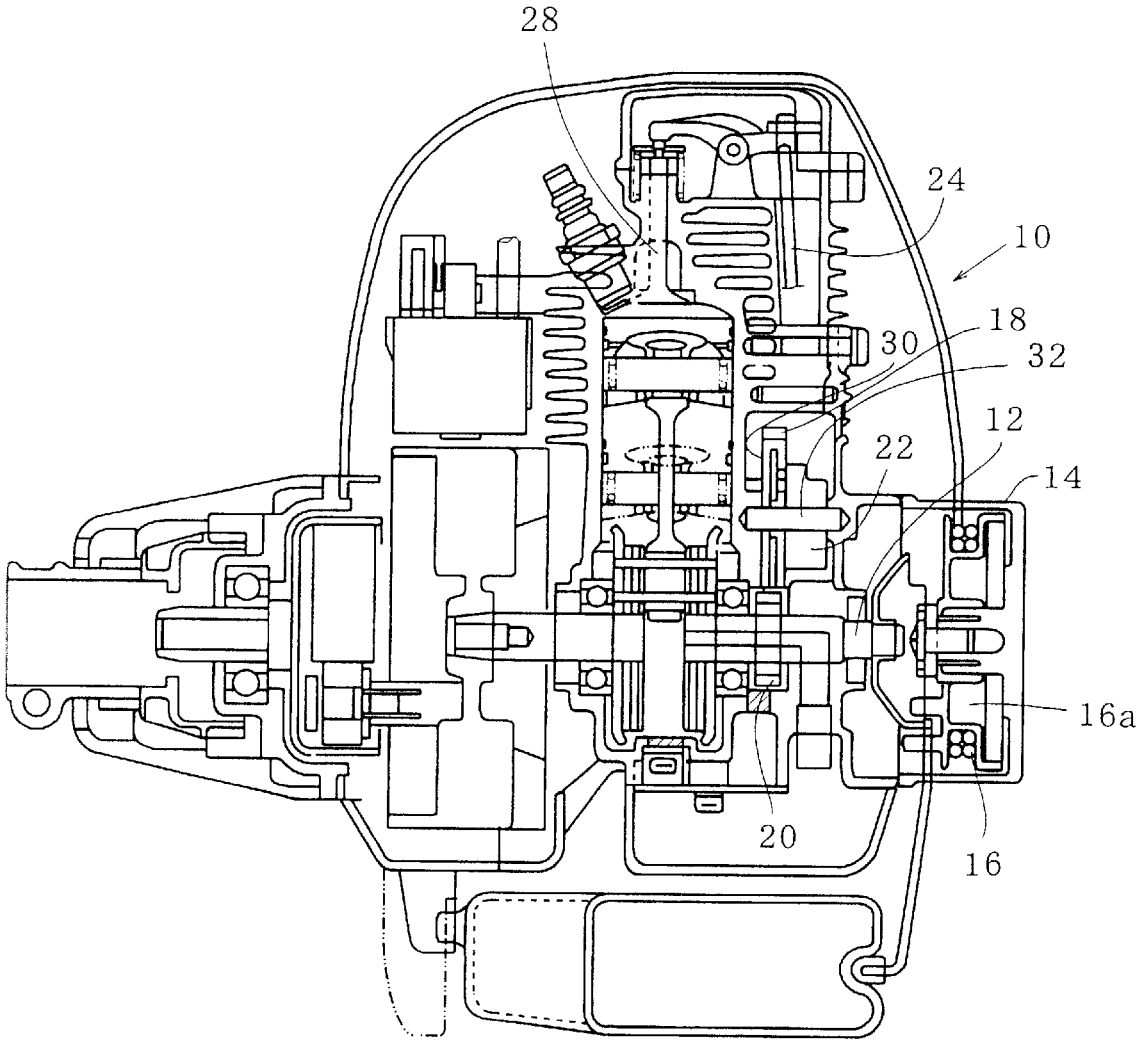
FIG. 1 is a schematic diagram showing a four-cycle engine of the manually started type.

Referring to FIG. 1, a recoil starter 14 is provided in a small hand starting four-cycle engine 10 for manually rotating a crankshaft 12 so as to start the engine 10. The crankshaft 12 is rotated by manually pulling a wire 16 wound around a reel 16*a* of the recoil starter 14 for the manual start of the engine 10. Securely mounted on the crankshaft 12 is a gear 20 which is engaged with a cam gear 18. A cam portion 22 is integrally formed on the side of the cam gear 18 as shown in FIG. 2.

Figure 2:
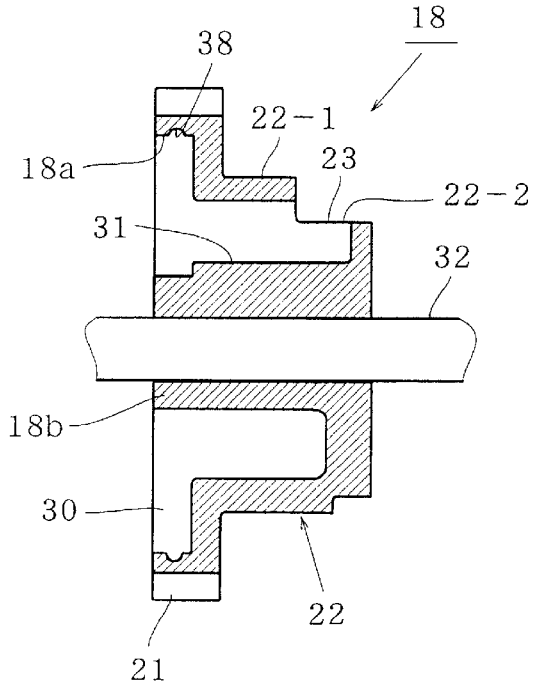
FIG. 2 is a sectional view of a cam gear.
Figure 4:
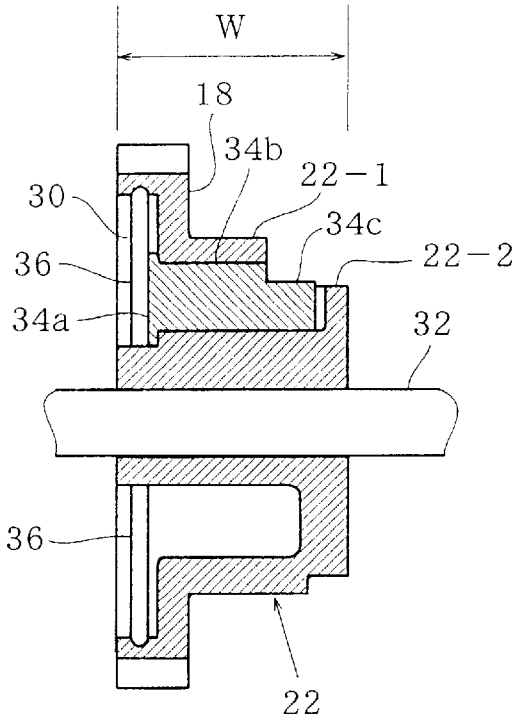
FIG. 4 is a sectional view taken along the line IV—IV of FIG. 3.
Figure 5:
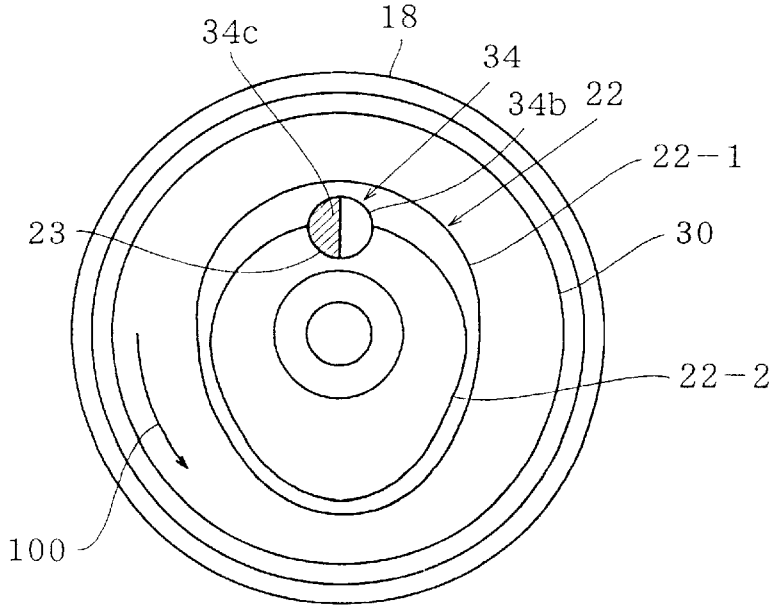
FIG. 5 is an explanatory side view as viewed from the right of FIG. 4.

Referring to FIGS. 2, 4, and 5, the cam gear 18 is rotatably mounted in the engine by a cam shaft 32 and has a gear portion 21. The cam gear 18 has an inlet cam 22-1 and an exhaust cam 22-2. In the cam gear 18, an annular groove 30 is formed thereby forming an annular inside wall 18*a* and a hub 18*b*. A cylindrical hole 31 is formed in the cam portion 22 in parallel with the crankshaft 12 at a position where the exhaust cam 22-2 causes an exhaust valve 28 to close through a pushrod 24 (FIG. 1). More specifically, the hole 31 is located at a central portion in the valve close area of the exhaust cam 22-2.

The hole 31 is extended to the exhaust valve, so that an exposed groove 23 has a semicircular section (FIG. 5).

Figure 3:
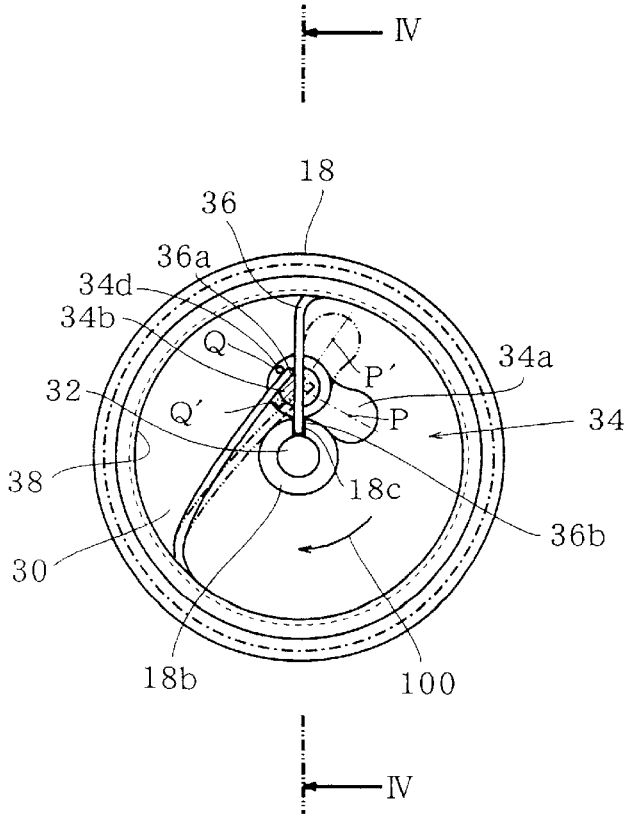
FIG. 3 is a side view as viewed from the left of FIG. 2.

In the hole 31, a decompression device 34 is rotatably mounted at a cylindrical shaft portion 34*b*. The decompression device 34 has a decompression cam 34*c* exposed from the exhaust cam 22-2 at the groove 23, and a weight 34*a* tangentially extending from the shaft portion 34*b* in the groove 30 as shown in FIG. 3.

An annular groove 38 is formed on the inside wall 18*a* of the annular groove 30 as shown in FIG. 2. In the groove 38, a wire spring 36 is engaged. An end 36*a* of the spring 36 is engaged with a pin 34*d* securely mounted on the side of the weight 34*a*, and the other end 36*b* is engaged in a groove 18*c* formed in the hub 18*b* so that the weight 34*a* is urged in the clockwise direction. Thus, the side 34*e* (FIG. 10) is oriented in the radial direction of the cam portion 22, so that the decompression cam 34*c* is projected from the exhaust cam 22-2 in the stationary state as shown in FIG. 5. Since the spring 36 is engaged in the groove 38, the spring is held without providing a holding means. Furthermore, the decompression device 34 is held by the spring 36 in the cam gear 18 without special holding means.

Therefore, the width W (FIG. 4) of the cam gear 18 can be reduced if compared with a conventional cam gear which is provided with various holding means.

In order to start, the wire 16 of the recoil starter 14 is pulled so that the crankshaft 12 is rotated in the direction of the arrow 100 (FIG. 5). At that time, the decompression cam 34*c* lifts the pushrod 24 so that the exhaust valve 28 is slightly opened in the compression stroke of the engine. Thus, the pressure in the combustion chamber is reduced, so that the manual force for starting the engine is reduced.

Figure 6:
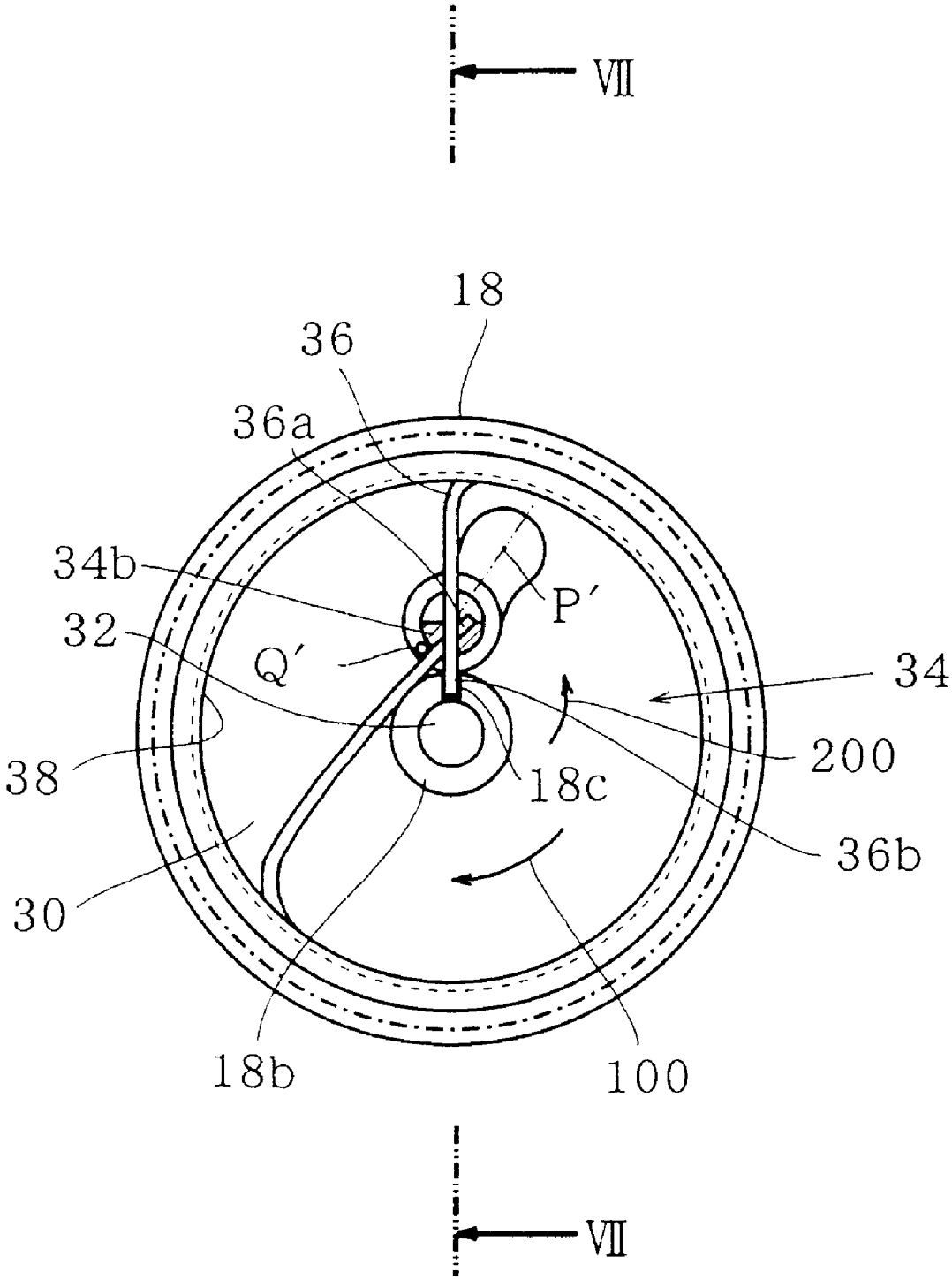
FIG. 6 is the same view as FIG. 3.
Figure 7:
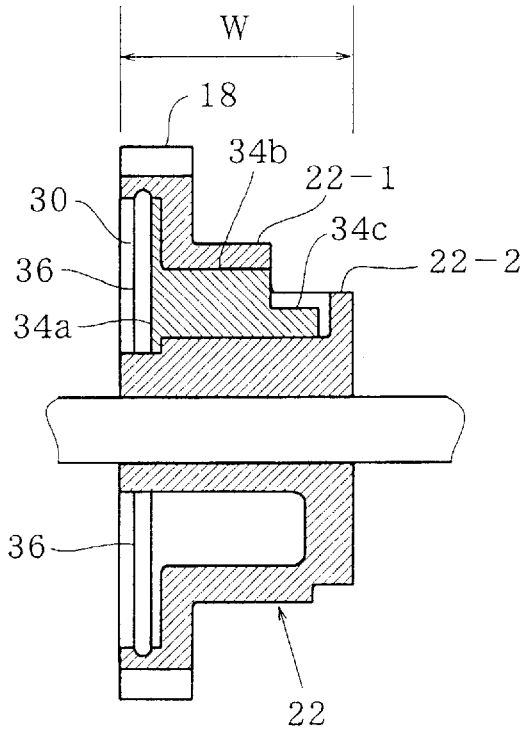
FIG. 7 is a sectional view taken along the line VII—VII of FIG. 6.
Figure 8:
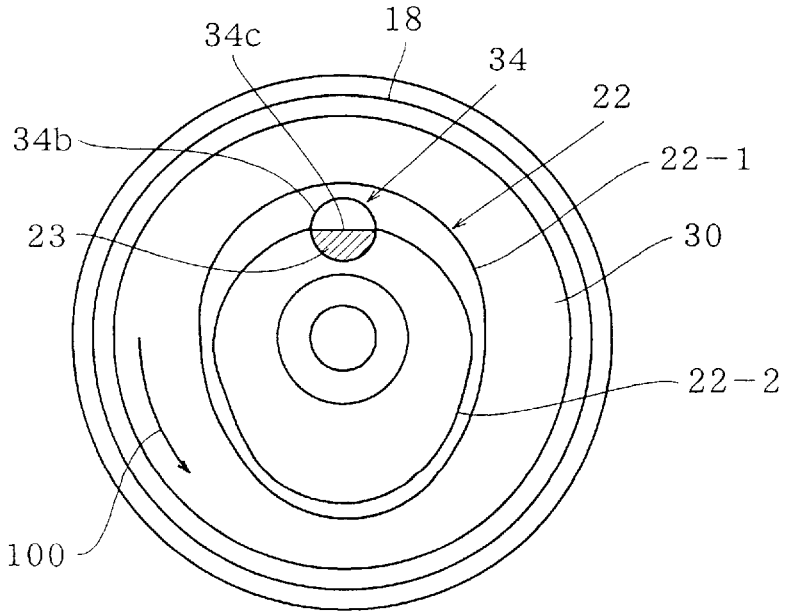
FIG. 8 is an explanatory side view as viewed from the right of FIG. 7.

When the engine 10 is started and the cam gear 18 is started at a rated speed, the centrifugal force on the weight 34*a* increases. Accordingly, the weight 34*a* is rotated in the direction of the arrow 200 of FIG. 6, so that the shaft portion 34*b* is rotated in the clockwise direction in FIG. 5. Thus, the decompression cam 34*c* is rotated in the exhaust cam 22-2 as shown in FIG. 8. Therefore, the exhaust valve 28 is not opened in the compression stroke, and hence the engine is normally operated.

Figure 9:
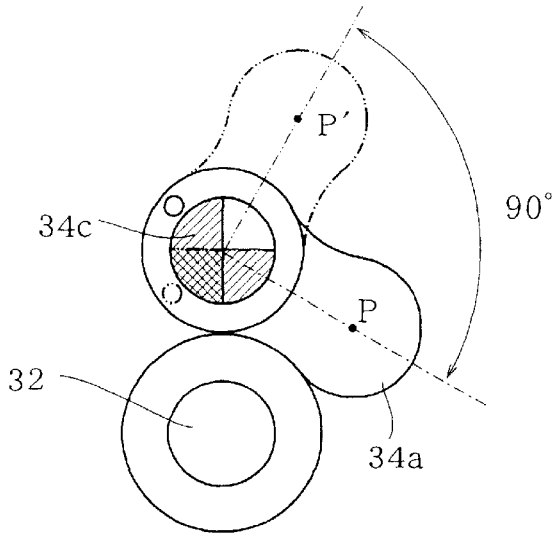
FIG. 9 is a side view showing a part of FIG. 3.

As shown in FIG. 9, the weight 34*a* is rotated from the position P to the position P' 90 degree.

Figure 10:
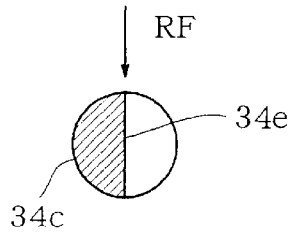
FIGS. 10 and 11 are side views showing positions of decompression cam.
Figure 11:
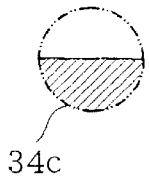

As shown in FIG. 10, the reaction force RF of the valve spring of the engine is applied on the decompression cam 34*c* in the direction of the side 34*e*, there is not generated a rotating force in the cam 34*c*.

As is understood from the foregoing, the weight of the weight 34*a* and the elastic force of the spring 36 are set so that the decompression cam 34*c* is projected from the exhaust cam 22-2 at the rotating speed in the hand starting operations, and retracted at the rotating speed after the starting of the engine.

Since the end 36*b* of the spring 36 is engaged in the groove 18*c*, a predetermined return force of the spring 36 is obtained.

Although the wire spring 36 is employed in the above described embodiment, another elastic means can be used for urging the weight to the camshaft.

In addition, it is possible to provide the decompression device in the inlet cam 22-1 so as to open the intake valve in the compression stroke.

From the foregoing it will be understood that the present invention provides a decompression device which has a simple construction and may be reduced in size since the decompression device is held in the cam gear without providing special holding means in spite of separately providing an intake cam and an exhaust cam. By the independent cams, the intake and exhaust valves can be controlled with high accuracy.

While the presently preferred embodiments of the present invention has been shown and described, it is to be understood that these disclosures are for the purpose of illustration and that various changes and modifications may be made without departing from the scope of the invention as set forth in the appended claims.

What is claimed is:

1. A decompression device for an engine having a crankshaft rotated by a recoil starter, a gear securely mounted on said crankshaft, a camshaft synchronously rotated by said crankshaft, a cam gear supported on said camshaft and meshed with said gear, and a push rod mechanically lifted for opening and closing a valve, the decompression device comprising:

a cam portion formed integrally on a periphery of said cam gear including an intake cam and an exhaust cam, a decompression element slidably and rotatable inserted in a hole of said cam portion in parallel with said crankshaft;

a decompression cam exposed from a groove with a semicircular section provided in said hole;

an annular groove provided at one of sides of said cam gear;

a weight provided in said annular groove and at an end of said decompression element; and a spring provided in the annular groove for urging said weight to said camshaft in hand-starting operation and moved apart from the camshaft by centrifugal force, thereby projecting said decompression cam in a compression stroke of the engine so as to open said valve.

2. The decompression device according to claim 1, wherein the spring is a wire spring provided between an inside wall of the annular groove and a back of the weight, and wherein all of the wire of the spring is disposed in said annular groove.

3. The decompression device according to claim 1, wherein said annular groove has a groove provided in a peripheral inside wall thereof for insertion of a part of said wire spring.

4. A decompression device for an engine having a crankshaft, a camshaft synchronously rotated by said crankshaft, a gear provided on said crankshaft, and a cam gear mounted on said camshaft, comprising:

an intake cam and an exhaust cam formed on the cam gear for operating an intake valve and an exhaust valve of the engine;

the cam gear provided with an annular groove at one of sides thereof and a cylindrical hole parallel with the camshaft;

the cylindrical hole being provided to form an exposed groove with a semicircular section;

a decompression device having a shaft portion rotatably mounted in the cylindrical hole of the cam gear;

a decompression cam exposed from the groove;

a weight provided in the annular groove and tangentially extending from the shaft portion;

a spring provided in the annular groove for urging the weight to the camshaft in hand-starting operation and moved apart from the camshaft by centrifugal force, thereby projecting the decompression cam in the compression stroke of the engine as to open the corresponding valve;

wherein the spring is a wire spring provided between an inside wall of the annular groove and a back of the weight; and a part of the wire spring is engaged in a groove in a peripheral inside wall of the annular groove.

* * * * *